US005732567A

United States Patent [19]

Anderson

[11] Patent Number: 5,732,567

[45] Date of Patent: Mar. 31, 1998

[54] CHILLER DEVICE FOR A PITCHER

[76] Inventor: Todd Anderson, 2983 Dorothy Dr., Aurora, Ill. 60504

[21] Appl. No.: 778,776

[22] Filed: Jan. 6, 1997

[51] Int. Cl.[6] ..... F25D 3/08

[52] U.S. Cl. ..... 62/457.4; 62/530

[58] Field of Search ..... 62/457.2, 457.3, 62/457.4, 457.8, 530, 371

[56] References Cited

U.S. PATENT DOCUMENTS

| | | | |
|---|---|---|---|
| 2,039,736 | 5/1936 | Munters et al. | 62/457.3 |
| 2,526,165 | 6/1950 | Smith . | |
| 4,151,923 | 5/1979 | Bernardi et al. . | |
| 4,691,664 | 9/1987 | Crowell . | |
| 4,843,836 | 7/1989 | Childers | 62/293 |
| 5,235,823 | 8/1993 | Coker | 62/530 |
| 5,299,433 | 4/1994 | Harms . | |
| 5,329,778 | 7/1994 | Padamsee . | |
| 5,507,156 | 4/1996 | Redmon | 62/400 |

*Primary Examiner*—William Doerrler
*Attorney, Agent, or Firm*—Michael I. Kroll

[57] ABSTRACT

A chiller device (10) for a pitcher (12) which holds a beverage (14). The pitcher (12) has a body (16) with an open top rim (18), a spout (20) on the open top rim (18) and a handle (22) on the body (16). The chiller device (10) comprises a sealed container (24) with a coolant (20) that becomes frozen is carried within the sealed container (24). A structure (28) is for maintaining the sealed container (24) with the coolant (26) within the body (16) of the pitcher (12), to keep the beverage (14) cold during a predetermined time interval. Even when the handle (22) is grasped by a hand of a person and the body (16) of the pitcher (12) tipped over to pour some of the beverage (14) from the spout (20) on the open top rim (18) into a glass, the sealed container (24) with the coolant (26) will stay within the body (16)) of the pitcher (12).

4 Claims, 2 Drawing Sheets

CHILLER DEVICE FOR A PITCHER

BACKGROUND OF THE INVENTION

1. Field of the Invention

The instant invention relates generally to cooling receptacles and more specifically it relates to a chiller device for a pitcher. The chiller device is intended for use in commercial applications (i.e. restaurants, beer gardens, private clubs, sports bars, taverns, etc.) and is not intended for home use at this time.

2. Description of the Prior art

Numerous cooling receptacles have been provided in prior art. For example, U.S. Pat. No. 2,526,165 to Smith; U.S. Pat. No. 4,151,923 to Bernardi; U.S. Pat. No. 4,691,664 to Crowell; U.S. Pat. No. 5,299,433 to Harms et al. and U.S. Pat. No. 5,329,778 to Padamsee all are illustrative of such prior art. While these units may be suitable for the particular purpose to which they address, they would not be as suitable for the purposes of the present invention as heretofore described.

SMITH, EULA LEE

COOLING RECEPTACLE

U.S. Pat. No. 2,526,165

A cooling receptacle comprising a continuous wall means defining the sides and end of a chamber open at one end for the reception of a desired contents. An additional wall means is joined to the portion of the first-mentioned wall means at the closed end of the chamber defining a permanently fully enclosed coolant chamber extending longitudinally of and within the first mentioned chamber. A quantity of coolant liquid is sealed in the coolant chamber substantially but not completely filling the same.

BERNARDI, DARIO

THERMALLY INSULATED PRE-CHILL DRINKING GLASS

U.S. Pat. No. 4,151,923

A thermally insulated pre-chill drinking glass comprising an inner cup having a predetermined high thermal mass and of a compact vitreous material, an outer cup adapted to receive and enclose the inner cup, and a pedestal for supporting the glass onto a surface. The inner and outer cups having mating conformations near the top for holding together the two cups while leaving an interspace therebetween, which is effective to ensure a good thermal insulation for a minimum bulk.

CROWELL, WILLIAM H.

PET RECEPTACLE

U.S. Pat. No. 4,691,664

A dish-like receptacle for serving liquids to small animals whereby a coolant source maintains the liquid at a reduced temperature over extended periods. The coolant source is a frozen gel which may be refrozen, regenerated or replaced as needed.

HARMS, JERRY E.

HARMS, SR., THOMAS C.

HARMS, JR., THOMAS C.

PITCHER HAVING MEANS FOR KEEPING BEVERAGE COLD

U.S. Pat. No. 5,299,433

A beverage container utilizing a cooling device for keeping a beverage cold over a protracted period of time, with such container having sidewalls and a bottom defining volume in which a beverage can be contained. The cooling device is operatively associated with a lower interior portion of the container and involves a closed receptacle of a refreezable, nontoxic substance. When the cooling device has become relatively warm, it is readily removable from contact with the lower interior portion of the container, so that it may be replaced by a freshly-chilled cooling device of like configuration, thus to keep the beverage at a desirably low temperature. We provide several different types of magnetic and mechanical devices for preventing the cooling device from being displaced when the pitcher is tilted to pour out some or all of its contents.

PADAMSEE, RIAZ A.

THERMALLY INSULATED BOTTLE AND METHOD OF ASSEMBLY THEREOF

U.S. Pat. No. 5,329,778

A thermal insulated bottle includes an outer container having an open end and an inner cup, which is at least partially received and spaced apart from the outer container. The inner cup and outer container engage each other, preferably by a shoulder at the open end of the outer container, which encloses the space between the inner cup and the outer container to form a chamber. Within the chamber, a sleeve of freezable fluid is positioned around the inner cup. A thermal insulating material occupies the rest of the chamber between the sleeve and the outer container.

SUMMARY OF THE INVENTION

A primary object of the present invention is to provide a chiller device for a pitcher that will overcome the shortcomings of the prior art devices.

Another object is to provide a chiller device for a pitcher that will keep beverages, such as beer and soft drinks, chilled for enjoyment at a desirable drinking temperature after being poured into the pitcher.

An additional object is to provide a chiller device for a pitcher that has a concentric arrangement of a frozen coolant to maximize a cooling contact area within the pitcher.

A still additional object is to provide a chiller device for a pitcher, in which the chiller device is intended for use in commercial applications (i.e. restaurants, beer gardens, private clubs, sports bars, taverns, etc.) and is not intended for home use at this time.

A further object is to provide a chiller device for a pitcher that is simple and easy to use.

A still further object is to provide a chiller device for a pitcher that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
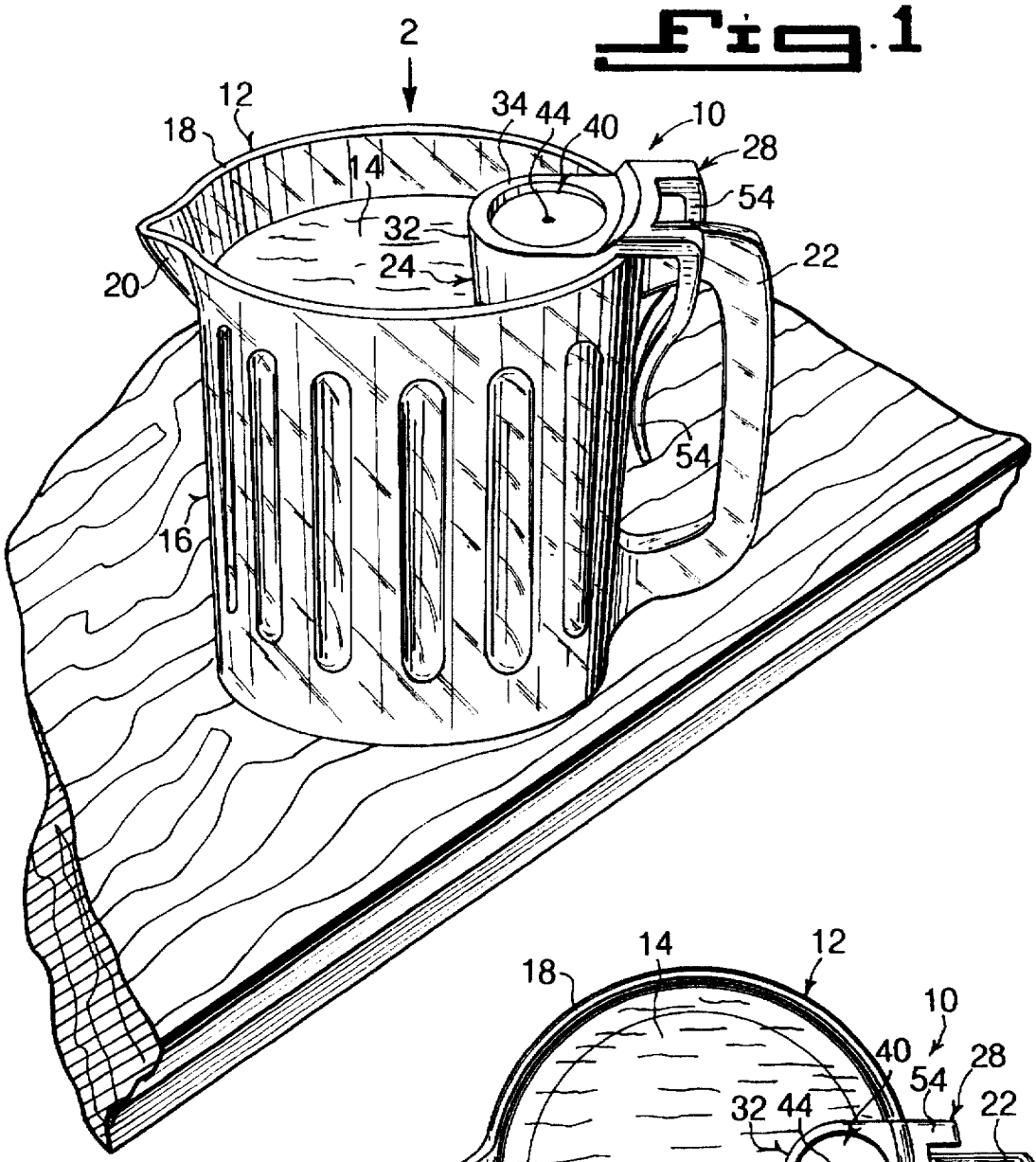
FIG. 1 is a top perspective view of the instant invention inserted into a pitcher to cool a beverage therein.
Figure 2:
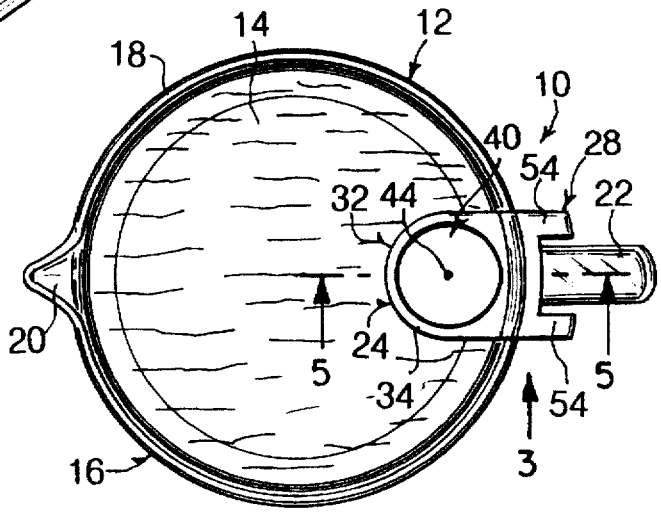
FIG. 2 is a top view taken in the direction of arrow 2 in FIG. 1.
Figure 5:
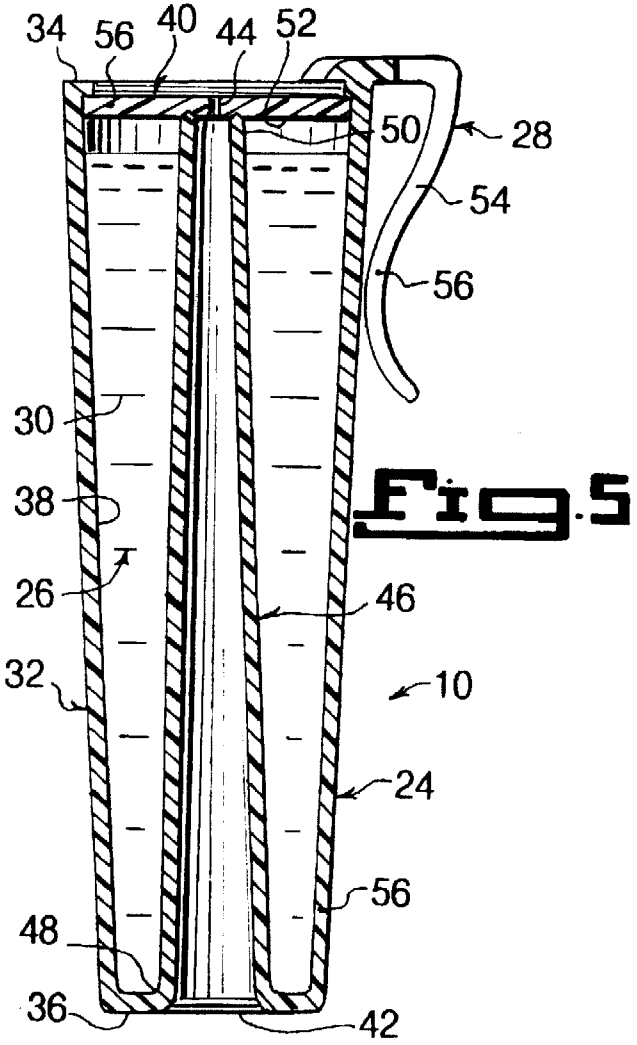
FIG. 5 is a cross sectional view of the instant invention per se, taken along line 5—5 in FIG. 2.
Figure 4:
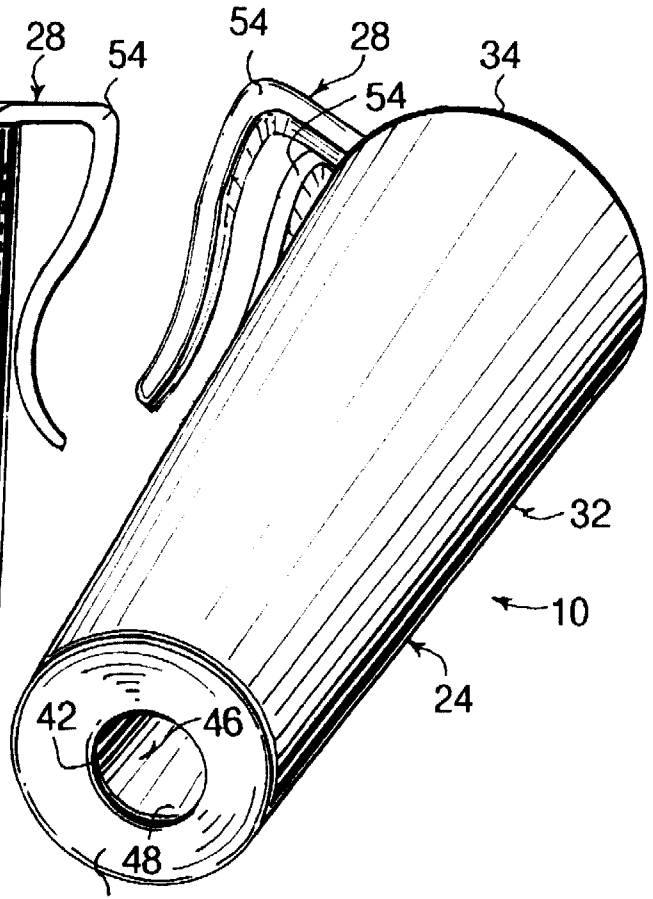
FIG. 4 is a bottom perspective view of the instant invention.
Figure 3:
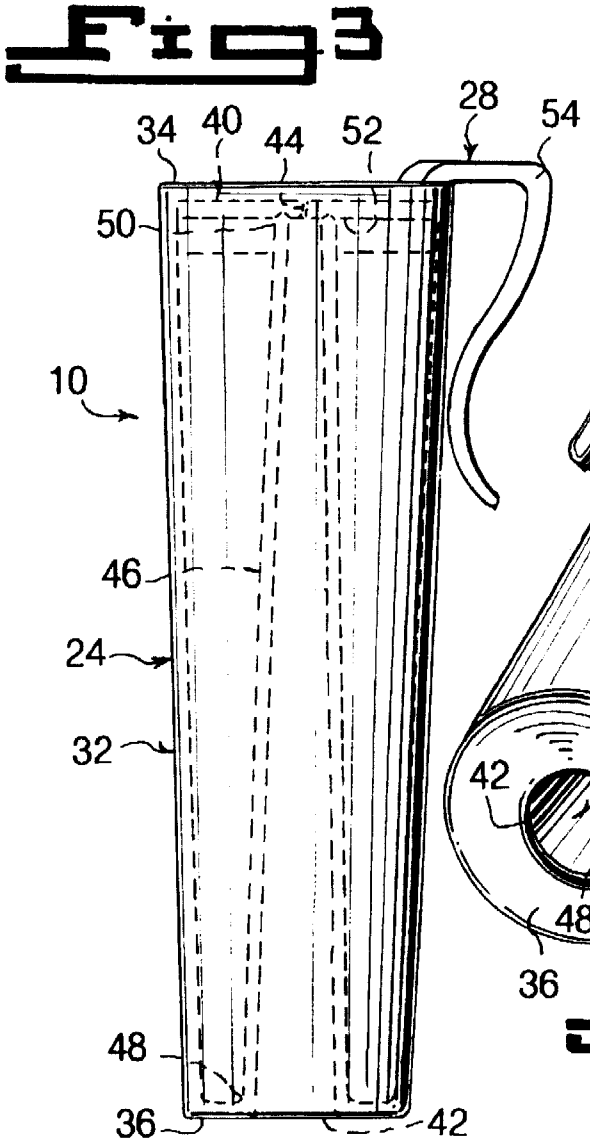
FIG. 3 is an elevational view of the instant invention per se taken in the direction of arrow 3 in FIG. 2.

Turning now descriptively to the drawings, in which similar reference characters denote similar elements throughout the several views, FIGS. 1 to 5 illustrate a chiller device 10 for a pitcher 12 which holds a beverage 14. The pitcher 12 has a body 16 with an open top rim 18, a spout 20 on the open top rim 18 and a handle 22 on the body 16. The chiller device 10 comprises a sealed container 24, with a coolant 26 that becomes frozen is carried within the sealed container 24. A structure 28 is for maintaining the sealed container 24 with the coolant 26 within the body 16 of the pitcher 12, to keep the beverage 14 cold during a predetermined time interval. Even when the handle 22 is grasped by a hand of a person and the body 16 of the pitcher 12 tipped over to pour some of the cold beverage 14 from the spout 20 on the open top rim 18 into a glass, the sealed container 24 with the coolant 26 will stay within the body 16 of the pitcher 12.

The coolant 26 is a nontoxic substance 30, known as "BLUE ICE", having a freezing point lower than water. The sealed container 24 includes a side wall 32 having an open top end 34. A bottom wall 36 is integral with the side wall 32, so as to form a chamber 38. A snap-fit lid 40 extends over the open top end 34 of the side wall 32 after the coolant 26 is placed within the chamber 38, so as to retain the coolant 26 therein.

The sealed container 24 further includes the bottom wall 36 having a large central opening 42 and the snap-fit lid 40 having a small central air hole 44. An inner core 46 wall has a bottom end 48 integrally formed about the large central opening 42 in the bottom wall 36 and extends upwardly with an open top end 50, to seal against a bottom surface 52 of the snap-fit lid 40 about the small central air hole 44. This allows the beverage 14 to extend about the side wall 24 and go up through the inner core wall 46 for a maximum chilling benefit.

The side wall 32 is generally cylindrical, with the diameter of the open top end 34 larger than the diameter of the bottom wall 36. The inner core wall 40 is generally cylindrical, with the diameter of the open top end 50 smaller than the diameter of the bottom end 48. The maintaining structure 28 consists of a pair of spaced apart clips 54 integrally formed on the open top end 34 of the side wall 32. The clips 54 will fit over the open top rim 18 of the pitcher 12 at opposite sides of the handle 22, to keep the sealed container 24 in place within the body 16 of the pitcher 12.

The sealed container 24 and the clips 54 are made out of a durable plastic material 56. The durable plastic material 56 can be polyethylene. The durable plastic material 56 can also be polypropylene.

The chiller device 10 is intended for use in commercial applications (i.e. restaurants, beer gardens, private clubs, sports bars, taverns, etc.) and is not intended for home use at this time.

OPERATION OF THE INVENTION

To use the chiller device 10, the following steps should be taken:

1. Insert the coolant 26, being the nontoxic substance 30 "BLUE ICE", into the chamber 38.
2. Secure the snap-fit lid 40 onto the open top end 34 of the side wall 32, so that the open top end 50 of the inner core wall 46 is sealed against the bottom surface 52 of the snap-fit lid 40.
3. Place the sealed container 24 with the coolant 26 into a freezer.
4. Remove the sealed container 24 from the freezer after the coolant 26 becomes frozen solid.
5. Put the clips 54 over the open top rim 18 of the pitcher 12 on opposite sides of the handle 22, so that the sealed container 24 with the frozen coolant 26 will go into the beverage 14 within the body 16 of the pitcher 12, to keep the beverage 14 cold.
6. Grasp the handle 22 by the hand and tip the body 16 of the pitcher 12 over to pour some of the cold beverage 14 from the spout 20 into a glass.

LIST OF REFERENCE NUMBERS

10 chiller device
12 pitcher
14 beverage in 12
16 body of 12
18 open top rim on 16
20 spout on 18
22 handle of 12
24 sealed container of 10
26 coolant in 24
28 maintaining structure of 10
30 nontoxic substance "BLUE ICE" for 26
32 side wall of 24
34 open top end of 32
36 bottom wall of 24
38 chamber in 24
40 snap-fit lid of 24
42 large central opening in 36
44 small central air hole in 40
46 inner core wall of 24
48 bottom end of 46
50 open top end of 46
52 bottom surface of 40
54 clip of 28
56 durable plastic material for 24 and 54

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A chiller device for a pitcher which holds a beverage, the pitcher having a body with an open top rim, a spout on the open top rim and a handle on the body, said chiller device comprising:

a) a sealed container comprising a side wall having an open top end, a bottom wall integral with said side wall having a large central opening at the bottom of said container, a snap-fit lid with a small central air hole covering said open top end of said side wall, an inner core wall having a bottom end integrally formed with said bottom wall around said central opening and extending upwardly with a top end to seal against a bottom surface of said snap-fit lid about said small central air hole forming an annular chamber closed at the top by said snap-fit lid and a central passageway open at the bottom through said central opening in said bottom end and ventilated at the top through said small central air hole in said snap-fit lid, said snap-fit lid when removed giving access to said annular chamber and sealing said annular chamber when snapped in place;

b) a freezable coolant within said annular chamber; and c) means for maintaining said sealed container with said coolant when frozen within the body of the pitcher comprising a pair of spaced apart clips integrally formed on said open top end of said side wall fitted over the open top rim of said pitcher at opposite sides of said handle, to keep the beverage cold during a predetermined time interval, so that even when the handle is grasped by a hand of a person and the body of the pitcher tipped over to pour some of the beverage from the spout on the open top rim into a glass, said sealed container with said coolant will stay within the body of the pitcher, said side wall being generally cylindrical with the diameter thereof at the top end being larger than the diameter thereof at the bottom end, the inner core wall being generally cylindrical with the diameter at the open top end thereof communicating with said small central opening in said snap-fit lid being smaller than the diameter at the bottom end thereof, and the cross sectional area of said annular chamber being larger at the top end than at the bottom end thereof.

2. A chiller device for a pitcher as recited in claim 1, wherein said sealed container and said clips are made out of a durable plastic material.

3. A chiller device for a pitcher as recited in claim 2, wherein said durable plastic material is polyethylene.

4. A chiller device for a pitcher as recited in claim 2, wherein said durable plastic material is polypropylene.

* * * * *